US005283115A

United States Patent [19]

Shinohara et al.

[11] Patent Number: 5,283,115

[45] Date of Patent: Feb. 1, 1994

[54] TRANSPARENT SHEET HAVING HEAT-TRANSFERRED IMAGE THEREON

[75] Inventors: Hironobu Shinohara, Machida; Nobuyuki Sonobe, Shiki, both of Japan

[73] Assignee: Japan Synthetic Rubber Co., Ltd., Tokyo, Japan

[21] Appl. No.: 985,150

[22] Filed: Dec. 3, 1992

[51] Int. Cl.[5] ..... B41M 5/26

[52] U.S. Cl. ..... 428/195; 428/411.1; 428/913; 428/914

[58] Field of Search ..... 428/195, 913, 914, 484, 428/488.1, 411.1

[56] References Cited

U.S. PATENT DOCUMENTS 5,164,469 11/1992 Goto et al. ..... 526/281

OTHER PUBLICATIONS

Patent Abstracts of Japan, JP 2,196,832, Oct. 21, 1988, "Sheet or Film of Cyclic Olefin Polymer".

Patent Abstracts of Japan, JP 2,180,976, Dec. 28, 1988, "Sheet of Film of Drawn Copolymer of Norbornene . . . ".

Patent Abstracts of Japan, JP 63,234,201, Sep. 29, 1988, "Optical Thin Filmy Substance For Protecting Photoresist . . . ".

English Abstract of European Patent, EP 384,694, Aug. 29, 1990, "Sheet or Film Composition With At Least One . . . ".

*Primary Examiner*—Pamela R. Schwartz

*Attorney, Agent, or Firm*—Oblon, Spivak, McClelland, Maier & Neustadt

[57] ABSTRACT

A transparent sheet having a heat-transferred image thereon, characterized in that the transparent sheet per se consists of a thermoplastic resin having a norbornene skeleton and the image is composed of a toner adhered to the sheet by heat-transfer. The toner is adhered directly to the sheet through no adhesive. The transparent sheet is suitable for uses in conventional black-and-white and color copying machines, overhead projectors and the like.

9 Claims, 1 Drawing Sheet

TRANSPARENT SHEET HAVING HEAT-TRANSFERRED IMAGE THEREON

BACKGROUND OF THE INVENTION

1. Field of the Invention

This invention relates to a transparent sheet having a heat-transferred image thereon which is suitable to use in an overhead projector (referred to hereinafter as OHP) in which copying is effected by a heat transfer system printer.

2. Prior Art

In general, a transparent sheet for forming an image thereon by a heat transfer system and for use in the OHP is a stretched polyester sheet, the surface of which has been subjected to antistatic treatment or treatment for improving the toner-adherability, and images such as letters, figures, patterns and the like are copied on the sheet by means of a copying machine, and the sheet having images thus formed is used in the OHP.

In a copying machine, information is transferred with a molten toner onto a transparent sheet, so that the sheet curls or wrinkles in some cases. Also, when the toner does not sufficiently adhere to the sheet, the sheet is smudged and the information cannot exactly be transferred. With a conventional polyester sheet, a rubber-based adhesive layer, an acrylic resin adhesive layer or the like is coated on the sheet in order to improve the toner-adherability. However, even if such a treatment is applied to the sheet, the thus treated sheet is not necessarily sufficient in toner-adherability. Such adhesive layers impair the transparency of sheets for the OHP, and the sheet having coated thereon the adhesive layer has an disadvantage that when such sheets are subjected to the OHP the resulting screen becomes cloudy and indistinct.

Recently, use of color copies has been started, and in a color copying machine, three-color toners are successively fed onto a transparent sheet to form a color image at a temperature higher than in a black-and-white copying machine, so that the time for which the sheet is kept at such higher temperatures becomes longer. Under such high temperature conditions, conventional stretched polyester sheets become shrunk or softened, and hence, it has more often been caused than in the black-and-white copying that the sheet wrinkles or changes in dimension.

The transparent sheet on which an image has been copied in such a manner is subjected to the OHP to project the image on a screen; however, if the sheet is curled by heat during the copying the end portions of images are faded and the resulting images become indistinct. Also, owing to insufficient toner-adherability, the necessary images become indistinct or the toners are stripped off from the sheet during the repeated use thereof.

In recent years, use of the OHP has been more general than use of a slide in disclosure in academic society meetings and lecture meetings or representation by salesmen. For this purpose, sheets for the OHP are often carried and it has been strongly desired that the sheets are lighter. For lightening, it is necessary to make the specific weight of material for the transparent sheet smaller and make the sheet thinner. However, when a sheet having insufficient heat resistance is made thinner, the resulting thinner sheet has a tendency that the sheet wrinkles deeply during copying and the copying machine is jammed by the sheet.

In order to make the representation more beautiful, there is a strong desire of coloring sheets for the OHP. For this coloration, the sheet materials are required to have excellent compatibility with various dyestuffs, and the transparent sheets per se are required to be excellent in transparency because the coloration adversely affects the light transmissibility of the transparent sheets. Conventional polyester sheets are not always satisfactory in transparency, and cannot be said to be suitable for distinct coloration, resulting in a cloudy screen.

Other uses of the transparent sheets include celluloid pictures for animation. In the conventional celluloid pictures for animation, a triacetyl cellulose (referred to hereinafter as TAC) film is used as a transparent sheet, and the celluloid pictures are prepared by copying the original picture thereon through a carbon paper and coloring the copied picture. Usually, several celluloid picture sheets are used in pile, and therefore, excellent transparency is strongly required. Hence, the TAC film has been used. However, the TAC film is inferior in heat resistance and has been unable to be subjected to copying by a heat transfer system, and therefore, a copy has been made thereon through a carbon paper. In this case, however, the copied image has been uneven and tended to be smudged, and therefore, amendment and correction of the image have been necessary. For simplifying the amendment and correction step, a transparent sheet on which a copy can be made by a heat transfer system has been desired. Conventional polyester sheets are not so sufficient in transparency as to be used to make a celluloid picture for animation, and when several sheets thereof are put one on another the resulting screen is cloudy and no clear image can be obtained. Thus, the conventional polyester sheets cannot be used as sheets for making a celluloid picture.

SUMMARY OF THE INVENTION

This invention has been made in the abovementioned technical background. The transparent sheet having a heat-transferred image thereon of this invention is excellent in transparency, so that the image is light and several sheets can be put one on another as a celluloid picture for animation, and when the sheet per se is colored, clear colors are obtained. Also, the transparent sheet of this invention is excellent in toner-adherability, and hence, the image formed thereon is clear, difficult to smudge and excellent in durability. In addition, since the sheet is excellent in heat resistance, the sheet does not curl during copying, the softening of the sheet is not caused, and the change in dimension of the sheet is small even at such high temperatures as in color-copying.

Thus, this invention aims at providing a transparent sheet having a heat-transferred image thereon by which a plurality of improvements have been made at one time.

According to this invention, there is provided a transparent sheet having an image thereon, characterized in that the sheet consists of a thermoplastic resin having a norbornene skeleton, and the image is composed of a toner adhered by heat-transfer.

BRIEF DESCRIPTION OF THE ACCOMPANYING DRAWINGS

FIG. 1 is a graph showing relations between transmittance and wavelength of the sheets having a heat-transferred image obtained in Example 4 and Comparative Example 2.

DETAILED EXPLANATION OF THE INVENTION

The transparent sheet before applying a heat-transfer image thereonto in this invention consists of a thermoplastic resin having a norbornene skeleton in its recurring units. The thermoplastic resin may be, for example, a thermoplastic resin having one of the norbornene skeletons represented by formulas (I) to (IV):

(I)

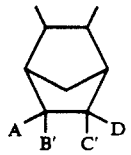

(II)

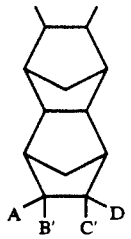

(III)

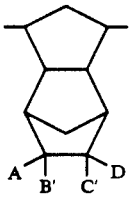

wherein A, B', C' and D may be the same as or different from one another and each represents a hydrogen atom, a hydrocarbon group having 1-10 carbon atoms, a halogen atom, a halogen-substituted hydrocarbon group having 1-10 carbon atoms, $-(CH_2)_nCOOR^1$, $-(CH_2)_nOCOR^1$, $-(CH_2)_nOR^1$, $-(CH_2)_nCN$, $-(CH_2)_nCONR^3R^2$, $-(CH_2)_nCOOZ$, $-(CH_2)_nOCOZ$, $-(CH_2)_nOZ$ or $-(CH_2)_nW'$, and B' and C' may be bonded to each other to form

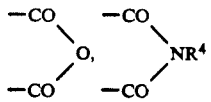

or a (poly)cycloalkylene group, in which $R^1$, $R^2$, $R^3$ and $R^4$ may be the same as or different from one another and each represents a hydrocarbon group having 1-20 carbon atoms; Z represents a halogen-substituted hydrocarbon group having 1-10 carbon atoms; W' represents $-SiR_p^5X_{3-p}$ in which $R^5$ is a hydrocarbon group having 1-10 carbon atoms, X is a halogen atom, $-OCOR^6$ or $-OR^6$ ($R^6$ is a hydrocarbon group having 1-10 carbon atoms) and p represents an integer of 0-3; and n represents an integer of 0-10.

Of these norbornene skeletons, the skeleton represented by formula (III) is preferred.

The thermoplastic resins having norbornene skeleton which can be used in this invention include those disclosed in, for example, Japanese Patent Application Kokai Nos. 60-168,708; 62-252,406; 62-252,407; 63-145,324; 63-264,626; 1-240,517; and 2-133,413, Japanese Patent Kokoku No. 57-8,815 and the like.

Specific examples of the thermoplastic resin include hydrogenation products of polymers obtained by subjecting at least one tetracyclododecene derivative represented by formula (V) to metathesis ring-opening polymerization:

(V)

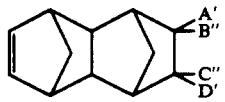

wherein A' and B'' may be the same as or different from each other and each represents a hydrogen atom or a hydrocarbon group having 1-10 carbon atoms; C'' represents a hydrogen atom or a hydrocarbon group having 1-10 carbon atoms; and D' represents $-(CH_2)_nCOOR^1$ or $-(CH_2)_nOCOR^1$ in which $R^1$ is a hydrocarbon group having 1-20 carbon atoms and n is an inteqer of 0-10.

In the tetracyclododecene derivatives represented by formula (V), it is preferable in view of toner-adherability that at least one of the A', B'', C'' and D' groups is a polar group. Moreover, this polar group is preferably a group represented by the formula $-(CH_2)_nCOOR^1$ in which $R^1$ and n are as defined above.

In particular, the polar group represented by the formula $-(CH_2)_nCOOR^1$ is preferably contained in a proportion of one group per molecule of tetracyclododecene derivative represented by formula (V).

Also, the smaller the integer n, the more effective the $-(CH_2)_nCOOR$: group.

In the above formulas, $R^1$ is a hydrocarbon group having 1-20 carbon atoms, and the number of carbon atoms is preferably as large as possible from the viewpoint that the hygroscopicity of the hydrogenated polymer obtained is reduced; however, it is preferable in view of balance between hygroscopicity and glass transition temperature of the hydrogenated polymer that $R^1$ is a straight chain alkyl group having 1-4 carbon atoms or a (poly)cyclic alkyl group having 5 or more carbon atoms. Particularly preferable are methyl group, ethyl group and cyclohexyl group.

Tetracyclododecene derivatives represented by formula (V) in which a hydrocarbon group having 1-10 carbon atoms is bonded as a substituent to the carbon atom to which a group represented by $-(CH_2)_nCOOR^1$ is bonded are preferred because they reduce the hygroscopicity. In particular, tetracyclododecene derivatives in which said substituent is a methyl or ethyl group are preferred.

Specific examples of the monomer used in this invention include bicyclo[2.2.1]hept-2-ene, tetracyclo[4.4.0.$1^{2,5}$.$1^{7,10}$]-3-deodeoene, tricyclo-[5.2.1.$0^{2,6}$]-8-decene, pentacyclo[6.5.1.$1^{3,6}$.$0^{2,7}$.$0^{9,13}$]-4-pentadecene, tricyclo[4.4.0.$1^{2,5}$]-3-undecene, 5-methoxycarbonylbicyclo[2.2.1]hept-2ene, 5-methyl-5-methoxycarbonylbicyclo[2.2.1]hept-2-ene, 5-cyanobicyclo[2.2.1]hept-2-ene, 8-methoxycarbonyltetracyclo[4.4.0.$1^{2,5}$.$1^{7,10}$]-3-dodecene, 8-ethoxycarbonyltetracyclo[4.4.0.$1^{2,5}$.$1^{7,10}$]-3-dodecene, 8-carboxy-n-propyltetracyclo[4.4.0.$1^{2,5}$.$1^{7,10}$]-3-dodecene, 8-isopropoxycarbonyltetracyclo[4.4.0.$1^{2,5}$.$1^{7,10}$]-3-dodecene, 8-n-butoxycarbonyltetracyclo[4.4.0.$1^{2,5}$.$1^{7,10}$]-3 -dodecene, 8-methyl-8-methoxycarbonyltetracyclo-[4.4.0.$1^{2,5}$.$1^{7,10}$]-3-dodecene, 8-methyl-8-ethoxycarbonyltetracyclo-

[4.4.0.$1^{2,5}$.$1^{7,10}$]-3-dodecene, 8-methyl-8-n-propoxycarbonyltetracyclo[4.4.0.$1^{2,5}$.$1^{7,10}$]-3-dodecene, 8-methyl-8-isopropoxycarbonyltetracyclo[4.4.0.$1^{2,5}$.$1^{7,10}$]-3-dodecene, 8-methyl-8-n-butoxycarbonyltetracyclo-[4.4.0.$1^{2,5}$.$1^{7,10}$]-3-dodecene, norbornene, dimethanoctahydronaphthalene, ethyltetracyclododecene, 6-ethylidene-2-tetracyclododecene, trimethanoctahydronaphthalene, pentacyclo[8.4.0.$1^{2,5}$.$1^{9,12}$.$0^{8,13}$]-3-hexadecene, pentacyclo[7.4.0.$1^{2,5}$.$1^{9,12}$.$0^{8,13}$]-3-pentadecene, pentacyclo[8.7.0.$1^{3,6}$.$1^{10,17}$.$1^{12,15}$.$0^{2,7}$.$0^{11,16}$]-4-eicosene, heptacyclo[8.8.0.$1^{4,7}$.$1^{11,13}$.$1^{13,16}$.$0^{3,8}$.$0^{12,17}$]-5-heneicosene, and the like.

Of these, 8-methyl-8-methoxycarbonyltetracyclo[4.4.0.$1^{2,5}$.$1^{7,10}$]-3-dodecene is preferable because a polymer obtained by subjecting this monomer to ring-opening polymerization has a high glass transition temperature and a low hygroscopicity.

The above-mentioned specific monomers are not required to be always used alone, and can be subjected in combination of two or more to ring-opening copolymerization.

One of these tetracyclododecene derivatives or a mixture thereof with an unsaturated cyclic compound copolymerizable therewith can be subjected to metathesis ring-opening polymerization and hydrogenation according to, for example, the method of Japanese Patent Application Kokai No. 4-77,520 to prepare a thermoplastic resin which can be used in this invention.

The hydrogenation degree of the hydrogenated polymer is such that the value obtained by measurement by $^1$H-NMR at 60 MHz is 50% or more, preferably 90% or more, more preferably 98% or more.

Incidentally, the gel content of the present thermoplastic resin having a norbornene skeleton is preferably 5% by weight or less, more preferably 1% by weight or less.

In this invention, the thermoplastic resin having a norbornene skeleton has preferably a weight-average molecular weight of 5,000–1,000,000, more preferably 8,000–200,000 for imparting a sufficient strength to a sheet of the resin.

In this invention, the thermoplastic resin having a norbornene skeleton has preferably an intrinsic viscosity $\{[\eta]_{inh}\}$ of 0.3–1.5 dl/g as measured at 30° C. in chloroform.

The thermoplastic resin having a norbornene skeleton may comprise additives such as a stabilizer, an antioxidant, a lubricant, an inorganic filler, an antistatic agent, an ultraviolet absorber, a fluorescent whitening agent, a plasticizer, a colorant and the like alone or in combination of two or more.

In this invention, the transparent sheet may be prepared from a thermoplastic resin having a norbornene skeleton by an extrusion method, a casting method or the like.

In this invention, the thickness of the transparent sheet is preferably 0.01–1 mm, more preferably 0.01–0.3 mm, particularly preferably 0.01–0.1 mm, and several sheets each consisting of a thermoplastic resin having a norbornene skeleton may be used in pile.

The transparent sheet used in this invention is excellent in toner-adherability, and therefore, it is not necessary to form a conventional rubber adhesive layer or acrylic resin adhesive layer on the transparent sheet.

In this invention, on a side of the transparent sheet other than the side to which a toner is adhered, it is possible to form an antistatic layer consisting of a surfactant or an electroconductive material such as cationic or anionic polymer, metal powder or the like.

Moreover, in this invention, it is possible to form various polymer layers on the transparent sheet for reinforcing the strength and preventing the sheet from being elongated or shrunk and other purposes.

To the transparent sheet thus obtained can be adhered a toner by a heat-transfer system, and any toner for heat-transfer may be used though a magnetic toner containing a magnetic substance is often used in a development system by only one component. Preferable for the magnetic toner is a toner in which a magnetic powder, a charge-controlling agent or the like is dispersed in a binder polymer and an external additive for controlling powder fluidity is also contained. The toner is in the form of particles and the average diameter of the particles is not critical though it is preferably 1–50 μm, and in view of image quality, it is more preferably 3–25 μm.

The binder polymer in the toner has preferably a glass transition temperature of 35°–100° C., more preferably 45°–75° C. in order for the polymer to be well melted by the heat in the fixing process and for the particles to be prevented from being agglomerated in the normal state. Specifically, a styrene-acrylate copolymer, a polyester and the like are preferably used. As the magnetic substance, iron oxide or ferrite particles having diameters of 1 μm or less are used.

In non-magnetic toners which are used in color copying machines, in general, pigments or dyestuffs are included in a binder polymer, and in the case of black toner, carbon black is preferably used.

To the toner may be internally added a charge-controlling agent for controlling the charge. The kind of the charge-controlling agent is not critical, though a quaternary ammonium salt or a metal complex of azo dye is preferably used. In order to prevent the toner from adhering to heated rolls in the fixing process, a low molecular weight wax such as polypropylene, polyethylene or the like may be internally added to the toner. Toners containing such internal additives may be preferably used. As the external additives, silica, titanium oxide, alumina and the like are used in many cases in order to control the charge and improve the fluidity, and toners containing such external additives are also preferably used.

The heat-transfer temperature is usually 90° C. or more, and the surface temperature of the heated roll for fixing a toner is generally controlled to 100°–200° C. In this invention, taking contact time with the roll into consideration, it is preferable to adjust the conditions so that the substantial temperature of the transparent sheet surface becomes lower than the glass transition temperature of the transparent sheet per se. In this invention, the substantial temperature of the transparent sheet surface is preferably 140°–170° C. in view of the toner-fixability.

The transparent sheet having a heat-transferred image thereon of this invention can be prepared by subjecting the transparent sheet to any copying machine such as a commercially available black-and-white copying machine, color copying machine or the like.

The transmittance of the transparent portion of the transparent sheet of this invention is usually 88% or more as measured at 400 nm according to ASTM D1003 and the haze thereof is 2% or less as measured at 400 nm according to ASTM D1003.

The transparent sheet having a heat-transferred image thereon of this invention can be used as a sheet for OHP in representation or as a celluloid picture for animation after being colored. Moreover, the transparent sheet of this invention is as light as 7.5 g or less as an A size sheet having a thickness of 100 μm (commercial one: 8.8 g), and hence, is advantageous in use in the form of a pile of several sheets.

DESCRIPTION OF PREFERRED EMBODIMENTS OF THE INVENTION

Figure 1:
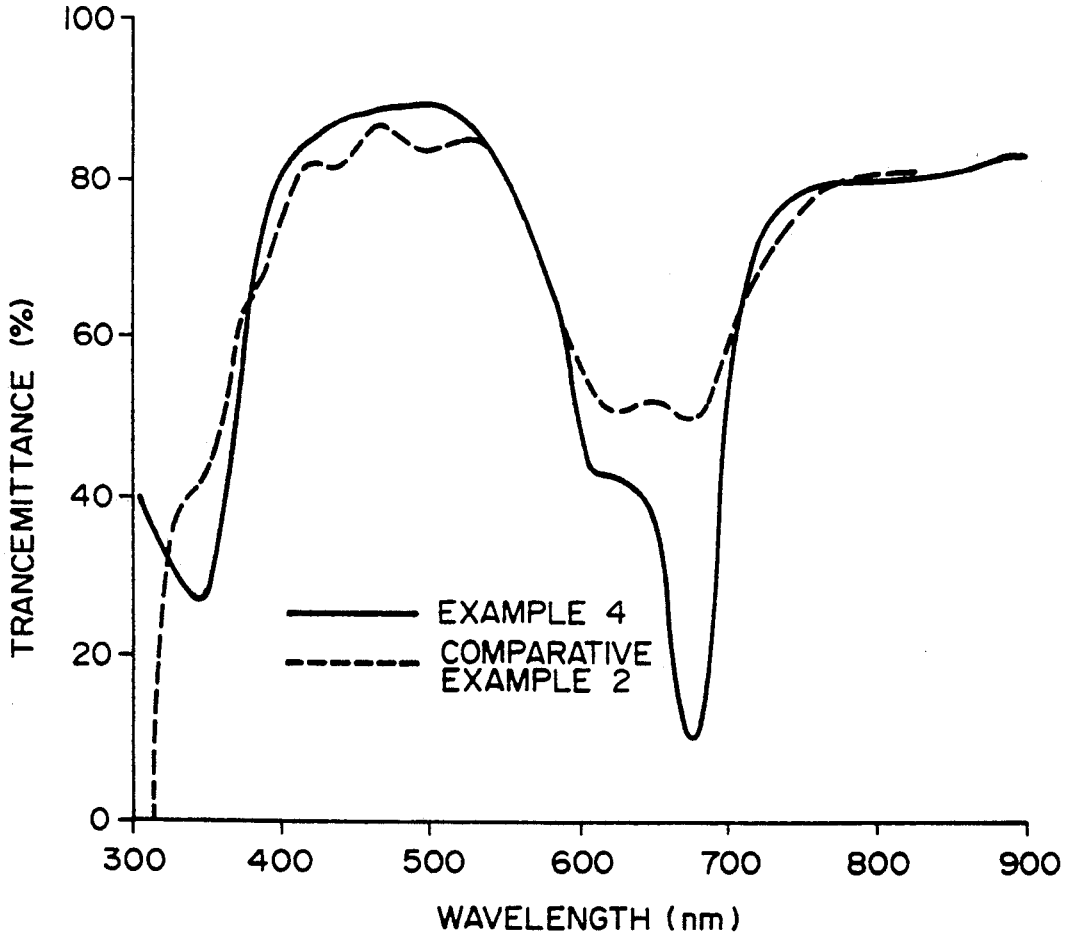

This invention is further explained in more detail below referring to Examples. However, the Examples are merely by way of illustration and not by way of limitation.

In the Examples, parts and percent are by weight unless otherwise specified.

REFERENCE EXAMPLE 1

In an autoclave having an internal volume of 1 liter were placed 100 g of 8-methyl-8-methoxycarbonyltetracyclo[4.4.0.$1^{2,5}$.$1^{7,10}$]dodec-3-ene having formula A

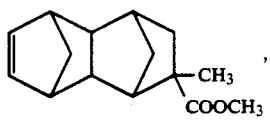

60 g of 1,2-dimethoxyethane, 240 g of cyclohexane, 25 g of 1-hexene and 3.4 ml of a 0.96 mole/liter solution of diethylaluminum chloride in toluene.

In a separate flask, 20 ml of a 0.05 mole/liter solution of tungsten hexachloride in 1,2-dimethoxyethane was mixed with 10 ml of a 0.1 mole/liter solution of paraldehyde in 1,2-dimethoxyethane. In the above-mentioned autoclave was placed 4.9 ml of the mixed solution thus obtained, and the autoclave was stoppered tightly, and thereafter, the resulting mixture was heated to 80° C. and stirred for 3 hours.

To the polymer solution thus obtained was added a mixed solvent of 1,2-dimethoxyethane and cyclohexane (2/8 by weight) to adjust the polymer/solvent ratio to 1/10 by weight, and thereafter, 20 g of triethanolamine was added thereto. The resulting solution was then stirred for 10 minutes.

To the polymer solution was added 500 g of methanol and then the resulting mixture was stirred for 30 minutes and then allowed to stand. The mixture separated into two layers, and the upper layer was removed therefrom. Methanol was again added to the residue, and the mixture was stirred and allowed to stand, after which the resulting upper layer was removed. The same procedure was repeated two times, and the lower layer thus obtained was appropriately diluted with cyclohexane and 1,2-dimethoxyethane to obtain a 10% solution of a polymer in cyclohexane-1,2-dimethoxyethane.

To this solution was added 20 g of paradium/silica-magnesia (paradium content =5%, manufactured by Nikki Kagaku Kabushiki Kaisha), and the resulting mixture was subjected to reaction in an autoclave at a hydrogen pressure of 40 kg/cm$^2$ at 165° C. for 4 hours, after which the hydrogenation catalyst was removed by filtration to obtain a hydrogenated polymer solution.

Also, to the hydrogenated polymer solution was added pentaerithrityl tetrakis[30(3,5-di-t-butyl-4-hydroxyphenyl)propionate] as an antioxidant in a proportion of 0.1% based on the weight of the hydrogenated polymer, and the resulting mixture was subjected to reduced pressure at 380° C. to remove the solvent.

Subsequently, the molten resin was pelletized by an extruder under a nitrogen atmosphere to obtain a thermoplastic resin having an intrinsic viscosity of 0.5 dl/g as measured at 30° C. in chloroform, a hydrogenation degree of 99.5% and a glass transition temperature of 168° C.

REFERENCE EXAMPLE 2

6-Ethylidene-2-tetracyclododecene was subjected to metathesis ring-opening polymerization, hydrogenation and pelletization in the same manner as in Reference Example 1 to obtain a thermoplastic resin having an intrinsic viscosity of 0.56 dl/g as measured at 30° C. in chloroform, a hydrogenation degree of 99% and a glass transition temperature of 140° C.

REFERENCE EXAMPLE 3

According to the method of Example 1 of Japanese Patent Application Kokai No. 62-252406, 55 mole % of ethylene and 45 mole % of 2-methyl-1,4,5,6-dimethano-1,2,3,4,4a,5,8,8a-octahydronaphthalene were subjected to addition polymerization using $VO(OC_2H_5)Cl_2$ and $Al(C_2H_5)_{1.5}Cl_{1.5}$ as a catalyst, and the resulting polymerization mixture was poured into a large amount of acetone/methanol to precipitate a polymer, which was then pelletized at 260° C. to obtain a thermoplastic resin having an intrinsic viscosity of 0.64 dl/g as measured at 35° C. in decaline and a glass transition temperature of 140° C.

EXAMPLES 1-3

The pellets of thermoplastic resin obtained in Reference Examples 1-3 were extruded to form transparent sheets each having a length of 300 mm, a width of 210 mm and a thickness of 0.1 mm. A black-and-white image was transferred to some of the transparent sheets by means of a black-and-white copying machine (FT7470 manufactured by RICOH CO., LTD.).

Also, a color image was transferred to some of the transparent sheets by means of a color copying machine (ARATAGE 5330 manufactured by RICHO CO., LTD.).

The image-transferred sheets were tested for appearance, dimension stability, toner-adherability and transmittance to obtain the results shown in Tables 1 and 2, showing the data concerning black-and-white image and the data concerning color image, respectively.

COMPARATIVE EXAMPLE 1

A commercially available stretched polyester sheet of 0.1 mm in thickness having formed thereon an adhesive layer (OHP Film PPC-DX manufactured by Richo Kyoiku Kiki Kabushiki Kaisha) was subjected to heat-transfer by means of the same black-and-white or color copying machine as in Example 1 to form a black-and-white image or a color image on the sheet, and the image-transferred sheet was tested for appearance, dimension stability, toner-adherability, transmittance and heat resistance. The test results of the black-and-white image are shown in Table 1 and the test results of the color image are shown in Table 2.

Each of the tests was conducted as follows:

Appearance

The state of wrinkle of the sheet having a heat-transferred image was observed. The results are indicated on the following basis:

×: Many wrinkles were seen.
Δ: A few wrinkles were seen.
○: No wrinkle was seen.

Dimension Stability

A change in dimension of sheet before and after the heat-transfer was measured and evaluated on the following basis:

×: Dimension change exceeded 1%.
Δ: Dimension change was 0.5–1%.
○: Dimension change was less than 0.5%.

Toner-adherability

The toner-adhered surface was rubbed by finger and observed. The results of the observation are indicated on the following basis:

○: Toner was not stripped (100% of the toner was retained).
Δ: Toner was somewhat stripped (50–70% of the toner was retained).
×: Substantially all the toner was stripped (0–10% of the toner was retained).

Transmittance

Measured at 400 nm according to ASTM D1003.

○: More than 90%
Δ: 85–90%
×: Less than 85%

Heat Resistance

One hundred transparent sheets were subjected to successive copying by a black-and-white copying machine and it was judged which of the sheets caused jamming and this was repeated 10 times, after which the average number of sheets which were used until jamming was caused was calculated.

Haze

Measured at 400 nm according to ASTM D1003.

TABLE 1

| | Appearance | Dimension stability | Toner-adherability | Transmittance | Heat-resistance | Haze (%) |
|---|---|---|---|---|---|---|
| Example 1 | ○ | ○ | ○ | ○ | 100 | 1.1 |
| Example 2 | ○ | ○ | Δ | ○ | 50 | 1.5 |
| Example 3 | ○ | ○ | Δ | ○ | 70 | 1.5 |
| Comp. Ex. 1 | ○ | ○ | Δ | Δ | 15 | 2.4 |

TABLE 2

| | Appearance | Dimension stability | Toner-adherability | Transmittance |
|---|---|---|---|---|
| Example 1 | ○ | ○ | ○ | ○ |
| Example 2 | ○ | ○ | Δ | ○ |
| Example 3 | ○ | ○ | Δ | ○ |
| Comp. Ex. 1 | Δ | Δ | Δ | Δ |

EXAMPLE 4

A blue dyestuff (MACRO-LEX BLUE RR, manufactured by Bayer) was added to the pellets of thermoplastic resin obtained in Reference Example 1 in a proportion of 200 ppm, and the mixture was formed into a transparent sheet having a length of 300 mm, a width of 210 mm and a thickness of 0.1 mm in the same manner as in Example 1, after which the transparent sheet was subjected to heat-transfer in the same manner as in Example 1 to obtain a black-and-white image-transferred sheet.

COMPARATIVE EXAMPLE 2

A black-and-white image was transferred to a commercially available blue OHP sheet (0.1 mm in thickness, PPC 750 manufactured by 3M) in the same manner as in Example 1.

TEST EXAMPLE

The image-transferred transparent sheets obtained in Example 4 and Comparative Example 2 were measured for color development of blue dyestuff by means of a transmitted light spectrum. The results obtained are shown in FIG. 1.

In FIG. 1, the portion falling within the wavelength range of from 650 to 700 nm is the blue dyestuff. As can be seen from FIG. 1, the sheet of this invention having a heat-transferred image thereon shows a sharp color development of blue dyestuff.

EXAMPLE 5

A transparent sheet was prepared in the same manner as in Example 1, and a black-and-white image was transferred thereto in the same manner as in Example 1 using the original picture for animation. This image has neither cut lines nor uneven lines and is not required to be amended or corrected at all. Three sheets each having a heat-transferred image obtained were put one on another and the resulting assembly was measured for transmittance of light of a wavelength of 400 to 700 nm to find that the transmittance was 78.5% which is the same as that of triacetylcellulose (TAC) film which had been conventionally used.

COMPARATIVE EXAMPLE 3

A TAC film having a thickness of 100 μm was subjected to black-and-white copying machine in the same manner as in Example 1, upon which large wrinkles were formed, and therefore, the TAC film was substantially unable to be used for animation. The TAC film was subjected to copying with a carbon paper, upon which cut liens and uneven lines appear, and therefore, amendment was necessary.

COMPARATIVE EXAMPLE 4

Three of the same commercially available OHP sheets as in Comparative Example 1 were put one on another and the transmittance of the resulting assembly was tested to find that the the transmittance thereof was 62.5%. That is, the transmittance is considerably inferior to that in Example 5, and hence, it is seen that a light image for amination is substantially unable to be obtained.

The transparent sheet having a heat-transferred image thereon of this invention is excellent in heat resistance, and does not curl nor change in dimension during image-transferring. Also, it is excellent in toner-adherability, and therefore, it is not necessary to form any adhesive layer on the sheet. Hence, the transparency of the sheet having a heat-transferred image can be kept well.

Moreover, even when the thickness of the transparent sheet of this invention is about 0.05 mm, the sheet does not cause jamming because of its excellent heat resistance.

The transparent sheet having a heat-transferred image thereon of this invention can be appropriately used in applications requiring transparency such as celluloid picture, second original picture or the like for animation.

What is claimed is:

1. A transparent sheet having an image thereon, characterized in that the transparent sheet consists of a thermoplastic resin having a norbornene skeleton and the image is composed of a toner adhered to the sheet by heat-transfer.

2. The transparent sheet according to claim 1, wherein the norbornene skeleton is selected from those represented by formulas (I) to (IV):

(I)

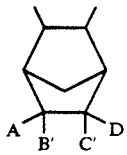

(II)

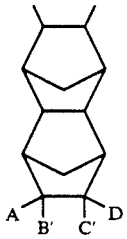

(III)

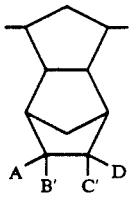

(IV)

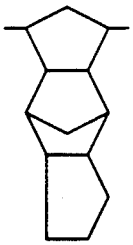

wherein A, B', C' and D may be the same as or different from one another and each represents a hydrogen atom, a hydrocarbon group having 1-10 carbon atoms, a halogen atom, a halogen-substituted hydrocarbon group having 1-10 carbon atoms, $-(CH_2)_nCOOR^1$, $-(CH_2)_nOCOR^1$, $-(CH_2)_nOR^1$, $-(CH_2)_nCN$, $-(CH_2)_nCONR^3R^2$, $-(CH_2)_nCOOZ$, $-(CH_2)_nOCOZ$, $-(CH_2)_nOZ$ or $-(CH_2)_nW'$, and B' and C' may be bonded to each other to form

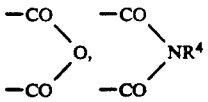

or a (poly)cycloalkylene group, in which $R^1$, $R^2$, $R^3$ and $R^4$ may be the same as or different from one another and each represents a hydrocarbon group having 1-20 carbon atoms; Z represents a halogen-substituted hydrocarbon group having 1-10 carbon atoms; W' represents $-SiR^5_pX_{3-p}$, wherein $R^5$ is a hydrocarbon group having 1-10 carbon atoms, X is a halogen atom, $-OCOR^6$ or $-OR^6$, wherein $R^6$ is a hydrocarbon group having 1-10 carbon atoms, and p is an integer of 0-3; and n represents an integer of 0-10.

3. The transparent sheet according to clam 2, wherein the norbornene skeleton is a norbornene skeleton represented by formula (III).

4. The transparent sheet according to claim 1, wherein the transparent sheet consists of a hydrogenated polymer obtained by subjecting a tetracyclododecene derivative represented by formula (V) to metathesis ring-opening polymerization and hydrogenation:

(V)

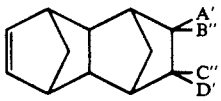

wherein A' and B'' may be the same as or different from each other and each represents a hydrogen atom or a hydrocarbon group having 1-10 carbon atoms; C'' represents a hydrogen atom or a hydrocarbon group having 1-10 carbon atoms; and D' represents $-(CH_2)_nCOOR^1$ or $-(CH_2)_nOCOR^1$ in which $R^1$ is a hydrocarbon group having 1-20 carbon atoms and n is an integer of 0-10.

5. The transparent sheet according to claim 1, wherein the transparent sheet has a thickness of 0.02-0.1 mm.

6. The transparent sheet according to claim 1, wherein the toner is adhered directly to the sheet through no adhesive.

7. The transparent sheet according to claim 1, wherein the heat-transfer temperature is 90° C. or more.

8. The transparent sheet according to claim 1, wherein the transmittance is 88% or more as measured at 400 nm according to ASTM D1003.

9. The transparent sheet according to claim 1, wherein the haze is 2% or less as measured at 400 nm according to ASTM D1003.

* * * * *